US008307477B2

(12) United States Patent
Boucquey

(10) Patent No.: US 8,307,477 B2
(45) Date of Patent: Nov. 13, 2012

(54) BED RAIL

(75) Inventor: Sebastien Boucquey, Brussels (BE)

(73) Assignee: Indowoods S.A., Brussels (BE)

( * ) Notice: Subject to any disclaimer, the term of this patent is extended or adjusted under 35 U.S.C. 154(b) by 0 days.

(21) Appl. No.: 13/329,482

(22) Filed: Dec. 19, 2011

(65) Prior Publication Data

US 2012/0151675 A1 Jun. 21, 2012

Related U.S. Application Data

(63) Continuation of application No. PCT/EP2010/002444, filed on Apr. 21, 2010.

(30) Foreign Application Priority Data

Jun. 17, 2009 (DE) ..... 10 2009 025 625

(51) Int. Cl.
*A47C 21/08* (2006.01)

(52) U.S. Cl. ..... 5/425; 5/426; 5/428

(58) Field of Classification Search ..... 5/424–430, 5/2.1, 9.1, 53.1, 193, 280, 512
See application file for complete search history.

(56) References Cited

U.S. PATENT DOCUMENTS

| | | | | |
|---|---|---|---|---|
| 2,904,799 | A | 7/1958 | Berlin | |
| 3,402,409 | A * | 9/1968 | Kain | 5/426 |
| 4,724,556 | A | 2/1988 | Burnham | |
| 4,724,559 | A * | 2/1988 | Bly et al. | 5/425 |
| 5,038,430 | A * | 8/1991 | Bly | 5/425 |
| 5,201,085 | A | 4/1993 | Shamie | |
| 5,577,277 | A * | 11/1996 | Sundberg et al. | 5/426 |
| 2006/0162075 | A1 * | 7/2006 | Waldman et al. | 5/426 |

FOREIGN PATENT DOCUMENTS

| | | |
|---|---|---|
| DE | 299 10 791 U1 | 9/1999 |
| DE | 20 2004 009 820 U1 | 12/2005 |
| EP | 2 070 448 A1 | 6/2009 |
| FR | 2 074 831 A5 | 10/1971 |
| GB | 2 350 786 A | 12/2000 |

* cited by examiner

*Primary Examiner* — Michael Trettel
(74) *Attorney, Agent, or Firm* — Muncy, Geissler, Olds & Lowe, PLLC

(57) ABSTRACT

Bed rail for children, comprising a grid element being releasably attachable, wherein the grid element, in an attached state, is extending along an edge of a bed above a resting area, wherein the grid element can be releasably connected with a mounting base via a locking member, the mounting base being positionable under the resting area.

19 Claims, 3 Drawing Sheets

BED RAIL

This nonprovisional application is a continuation of International Application No. PCT/EP2010/002444, which was filed on Apr. 21, 2010, and which claims priority to German Patent Application No. DE 10 2009 025 625.3, which was filed in Germany on Jun. 17, 2009, and which are both herein incorporated by reference.

BACKGROUND OF THE INVENTION

1. Field of the Invention

The invention relates to a bed rail, in particular for children.

2. Description of the Background Art

Bed rails are known from practice which can be releasably attached at their ends to a headboard and a footboard of a bed, holders therefore being installed which are complex and difficult to actuate, let alone the necessity of raised headboards and footboards.

SUMMARY OF THE INVENTION

It is therefore an object of the invention to provide a bed rail which can be easily operated by an adult.

Via a releasable connection with a mounting base which can be positioned under the resting area, it becomes possible to attach and lock a grid element at a central position. The mounting base may be positioned under the resting area, enabling the mounting base to be fixed to the bed as well as to be withdrawn in a simple manner. Thereby, the bed rail may particularly be designed as a transportable unit which can be combined with almost any construction of beds. This furthermore allows for the use of the bed rail as a travel bed rail, for example as a take along safeguard for common hotel beds which can be easily attached.

In an embodiment of the invention, a grid rod of the grid element is received in a moveable manner. Thereby, detaching and/or fastening of the grid element can be done in a simple manner, in a preferred embodiment with just a single hand. For instance, actuation may be done by encompassing the moveable grid rod and a fixed, neighboring grid rod with one hand, wherein for safety reasons, the distances of the grid rods are chosen such that the encompassing is only possible by an adult's hand.

In an embodiment, the locking member comprises a groove extending along the grid element at least in an attached state, the groove being arranged at one of two, the grid element or the mounting base. The groove provides for a guided positioning in the course of the attachment as well as a simple and effective support of the attached grid element. In a preferred detail embodiment, the groove extends over just a part of a length of the grid element, preferredly no more than half of the length of the grid element and particularly preferred over no more than one third of the length of the grid element. Thereby a large section of a bed's edge remains not covered by the locking member on the side of the mounting base. Hence an operator can comfortably and freely sit on the bed in those sections, for example in order to insert or take out a child.

In an embodiment, the moveable grid rod can be strained in a locking direction by a spring element, said spring element in particular being supported in the region of the locking member. Thereby, a clicking shut of the locking member in the course of positioning the grid element at the mounting base is enabled with simple measures. Furthermore, a sufficiently high spring load secures against an unwilled actuation by a small child. For instance it may be provided that the force necessary for elongation of the spring element, or actuation of the grid rod, is not less than 50 Newton.

For a simple design and safe actuation, a first lock part is advantageously provided at the end of the grid rod, for example, in a slitted recess, wherein a second lock part is provided at the mounting base for the purpose of a releasable, positive fastening at the first lock part. By the positioning of the lock part in the slitted recess, the danger of injuries, e.g. caused by jamming or scraping, is reduced.

In an embodiment of the invention, the mounting base comprises at least one web member extending under the resting area and two web members which protrude in a V-shape from a support block of the locking member. Such web members may extend under a resting area, e.g. a mattress of the bed, and can be held by the weight of the resting area and the person lying thereon. Web parts extending in V-shape allow for a secure holding and low weight of the mounting base, wherein the mounting base can also be designed very short profiled.

In an embodiment, the mounting base can be attached, at least as an option, to the bed via a belt. Belts allow for a fixation which is secure and first of all universally adaptable to different beds. The mounting base can be designed such that the belts do not serve as a necessary, but additional securing. This allows for an at least provisional use of the bed rail even with beds which, because of their construction, are not suited for attachment of belts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
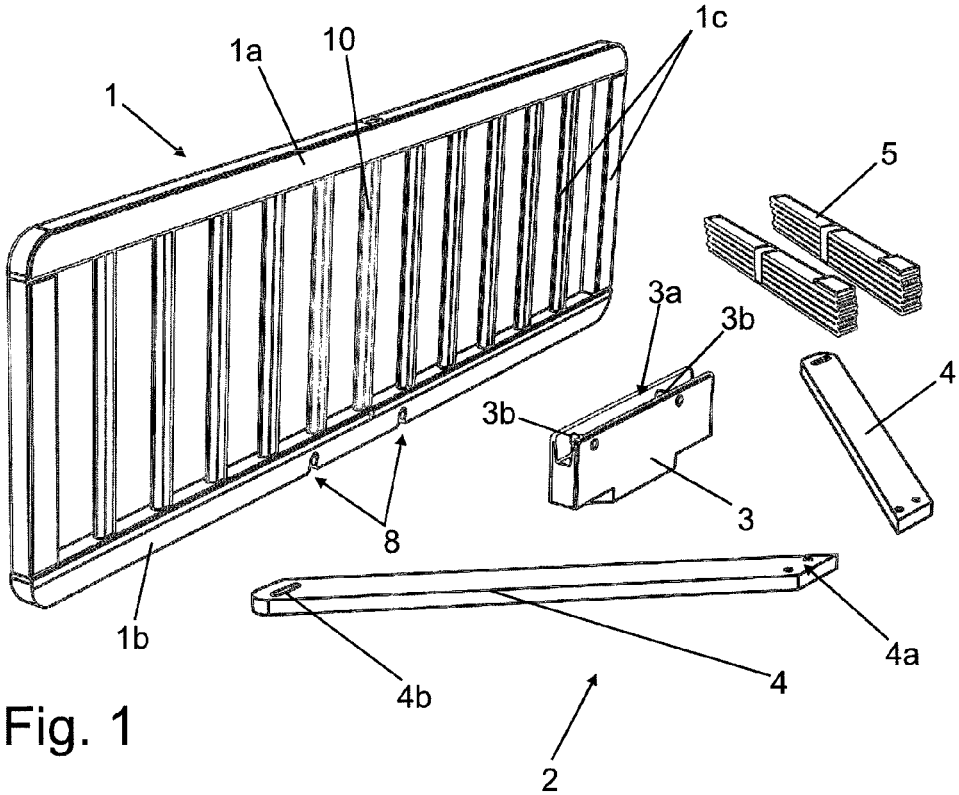
FIG. 1 shows a spatial view of an inventive bedrail dismantled into parts.

The bed rail according to the invention which is shown in FIG. 1 comprises a grid element 1 and a mounting base 2. The mounting base comprises a support block 3 forming a part of a locking member, two web parts 4 being screwed to the support block 3 and extending in a V-shape. The web parts 4 are formed as wooden lathes which, apart from boreholes 4*a* for screw connection with the support block 3, have slots 4*b* for attachment of respectively one belt 5.

Figure 2:
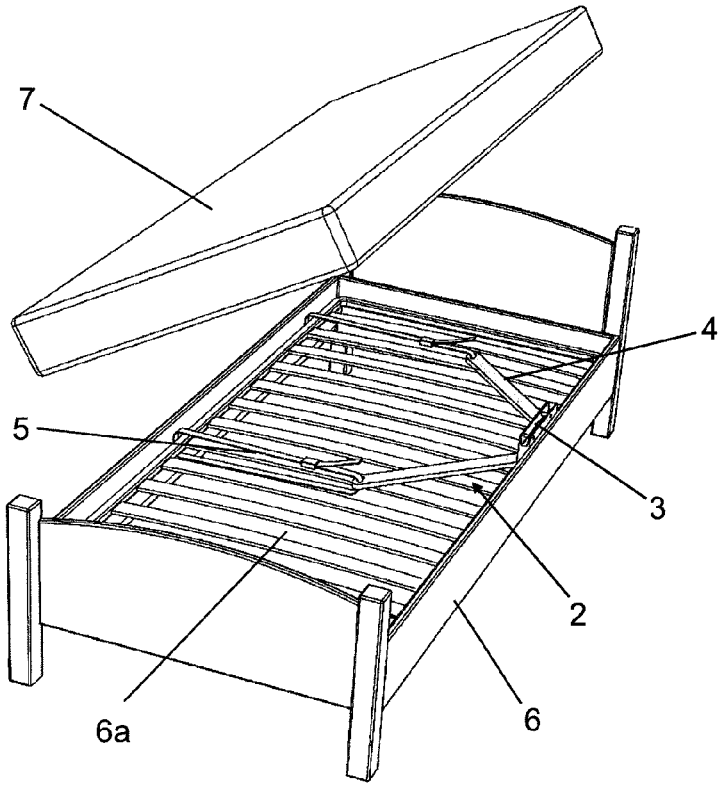
FIG. 2 shows a mounting base of the bed rail of FIG. 1 attached to a bed.

FIG. 2 shows that the mounting base 2 may be positioned at the edge of a usual bed of almost any construction, wherein the web parts 4 extend under a resting area 7, in this case provided as a mattress. The support block 3 protrudes at the bed edge from the underside and next to the mattress, hence allowing for the grid element 1 to be releasably attached to the support block 3 of the mounting base 2. The mounting base 2 can also be lashed to a slatted frame 6*a* or similar structure of the bed 6 for further securing.

The grid element 1 has the form of an elongated rectangle which extends along the longitudinal side of the bed (named longitudinal direction hereinafter) with an upper crossbar 1*a*, a lower crossbar 1*b* and grid rods 1*c* extending therebetween essentially perpendicularly.

In the longitudinal direction, that is horizontally, the grid element 1 has a length of about 120 cm. The support block 3 has a length of just about 25 cm in the longitudinal direction, providing that the grid element is more than three times longer, presently almost five times longer, than the support block 3. A groove 3*a*, into which the lower crossbar 1*b* of the grid element 1 can be inserted, extends over the full length of the support block 3.

In case of a different embodiment of the invention, the length of the grid element may be larger, e.g. 160 cm. The support block for attachment of a larger grid element can have unchanged dimensions (25 cm groove length, length ratio to the grid element about 1:6), or may as well have a greater length.

For positioning of the grid element in the longitudinal direction, two indentations 8 are provided at the lower crossbar 1*b*, wherein in each case a respective tenon 3*b* provided in the groove 3*a* is meshing with the indentations. The tenons are presently formed as bolts inserted into boreholes which are located at the height of the groove 3*a* and reach through it.

It has to be mentioned that the vast majority of the bed rail's parts, like e.g. grid rods 1*c*, crossbars 1*a*, 1*b*, support block 3 and bolts 3*b*, are made from wood. According to the demands, some or all of the mentioned parts may also be made from plastics, metal or another material.

Apart from the groove 3*a* with its tenons 3*b*, a locking member of the inventive bed rail comprises, on the side of the mounting base 2, a lock part in the form of a metal hook 9 which is inserted into the bottom of the groove 3*a*.

For a releasable attachment of the grid element 1 in the groove 3*a* of the support block, the locking member of the bed rail further comprises a moveably supported grid rod 10. The grid rod 10, like all other grid rods, is fixedly anchored in the upper crossbar 1*a*. In the lower crossbar 1*b*, the grid rod 10 is not fixedly anchored, but ends shortly before the crossbar 1*b*. A lock part formed as a metal hook 11 is screwed into the end face of the grid rod 10, the lock part reaching through a slitted opening 15 of the crossbar 1*b* and ending in a slitted recess 12, which is open towards the downside or, in the attached state, towards the bottom of the groove 3*a* (see FIG. 4).

Figure 4:
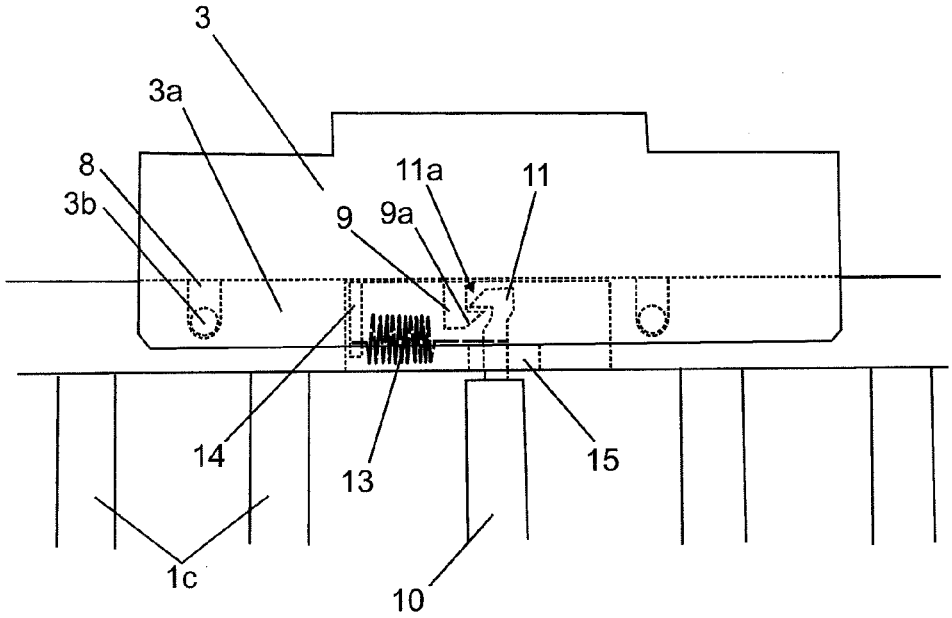
FIG. 4 shows a partial plan view of the bed rail of FIG. 1.
Figure 5:
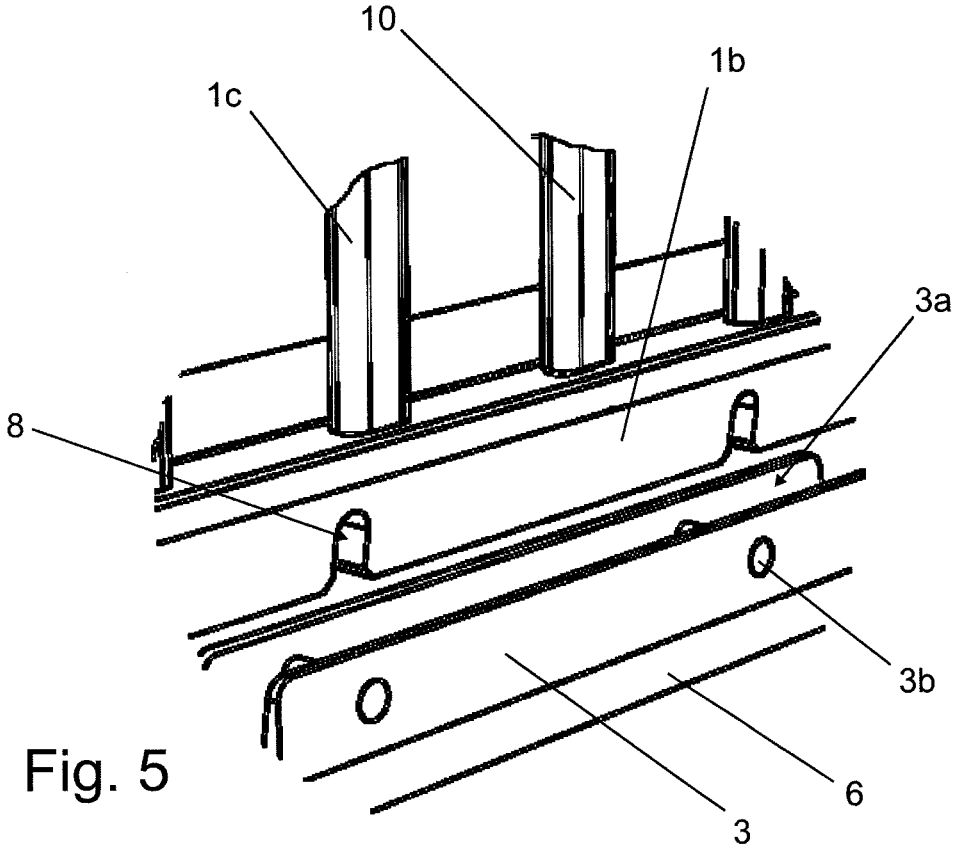
FIG. 5 shows a spatial detailed view of a locking member of the bed rail of FIG. 1.
Figure 6:
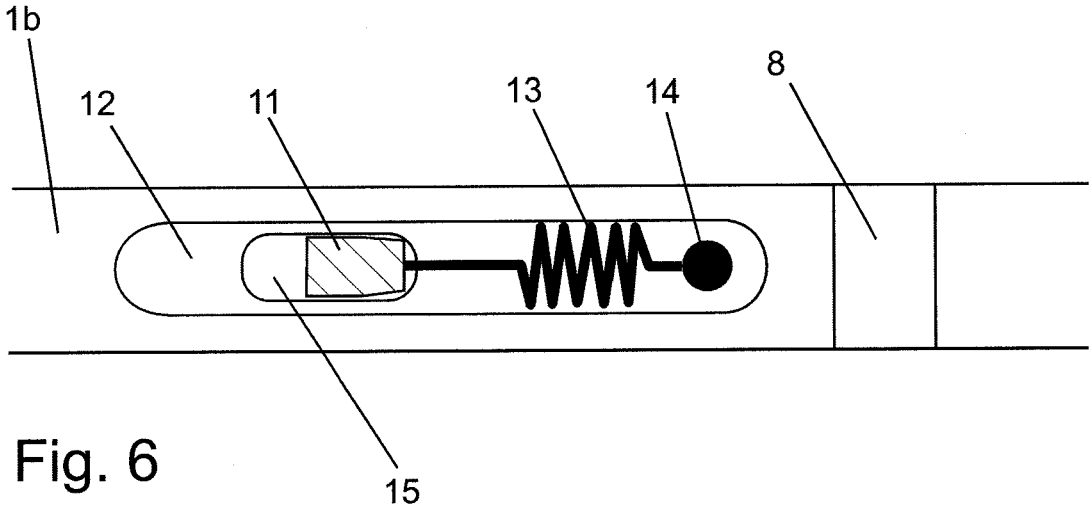
FIG. 6 shows a partial plan view from below of a grid element of the bed rail of FIG. 1.

In this recess 12, a spring element formed as a tensile loaded coil spring 13 is provided. On the one side, the spring element 13 is attached to the hook 11 and on the other side, the spring element 13 is attached to an anchor bolt 14 which is screwed into the crossbar 1*b* within the recess 12 (see also FIG. 6), providing strain in the locking direction to the moveable grid rod 10. As FIG. 4 shows, the hook-shaped lock parts 9, 11 engage with each other in a positive manner in the attached state of the grid element 1.

In the sense of the invention, on the side of the grid element 1 the locking member comprises the moveable grid rod 10 with the inserted lock part 11 as well as the supported spring element 13.

The spring and eventually the support of the grid rod 10 in the upper crossbar 1*a* are designed in such way that at the lower end of the grid rod, which is the point of the largest lever that can be applied from outwards, a force of at least 50 Newton in the longitudinal direction is necessary for releasing the grid rod.

Figure 3:
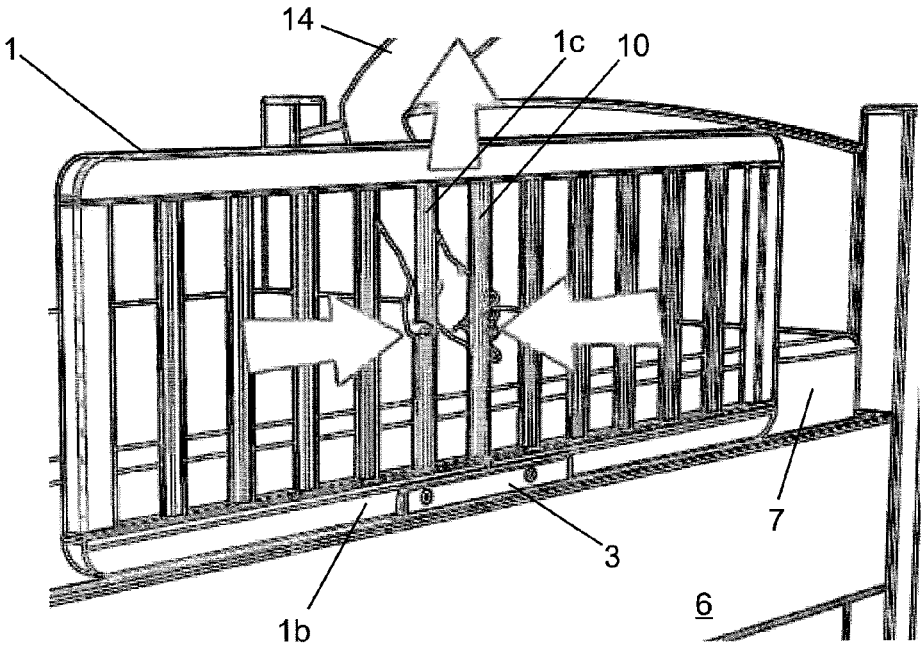
FIG. 3 shows the bed rail from FIG. 1 in an attached state in the course of releasing by an operator.

FIG. 3 points to the practical release procedure of the grid element. The operator 14 encompasses the moveable grid rod 10 and the fixed grid rod 1*c* which is neighbored in the moving direction with one hand. Then the moveable grid rod 10 is elongated from the locked position by compression and the grid element 1 is removed upwards (see arrows in FIG. 3). It is pointed out that the outer edges of the encompassed grid rods 10, 1*c*, have a distance of about 10 cm, encompassing and compression by a child's hand being made impossible.

The locking of the bed rail happens by simple insertion of the grid element 1 into the groove 3*a*, wherein the tenons 3*b* mesh with the indentions 8. Eventually, not shown markers may be provided on the outer faces of the parts 1*b*, 3 in order to make the positioning more easy. Thereafter, the grid element is pressed downwards into the groove 3*a* of the support block 3. In this course, firstly the moveable grid rod 10 is elongated in the opening direction against the force of the spring 13 by means of inclined sliding faces 9*a*, 11*a* provided at the lock parts, and then the lock parts 9, 11 click shut with each other in a positive manner.

It is to be understood that a locking member according to the invention and the specific form of the parts like e.g. the support block 3, are shown just exemplary, differing embodiments being possible and comprised by the term of the locking member.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A bed rail for children, the bed rail comprising:

a locking member;

a mounting base; and a grid element being releasably attachable to the mounting base, wherein the grid element, in an attached state, extends along an edge of a bed above a resting area, wherein the grid element is releasably connectable with the mounting base via the locking member, the mounting base being positionable under the resting area, and wherein a grid rod of the grid element is movably supported by the locking member in a moveable manner for the actuation of the locking member.

2. The bed rail according to claim 1, wherein the locking member comprises a groove extending along the grid element at least in an attached state, the groove being arranged at the grid element or the mounting base.

3. The bed rail according to claim 2, wherein the moveable grid rod is strained in a locking direction by a spring element, said spring element being supported in a region of the locking member.

4. The bed rail according to claim 2, wherein the groove extends over no more than half of the length of the grid element.

5. The bed rail according to claim 2, wherein the groove extends over no more than one third of the length of the grid element.

6. The bed rail according to claim 2, further comprising:

a first hook attached to the an end of the grid rod; and a second hook disposed within the groove and configured to releasably engage the first hook.

7. The bed rail according to claim 1, wherein a first lock part is provided at the end of the grid rod, wherein a second lock part is provided at the mounting base for the purpose of a releasable, positive fastening at the first lock part.

8. The bed rail according to claim 1, wherein the mounting base comprises at least one web member extending under the resting area.

9. The bed rail according to claim 1, wherein the mounting base is attachable to the bed via a belt.

10. The bed rail according to claim 8, wherein the mounting based comprises two web members which protrude in a V-shape from a support block of the locking member.

11. The bed rail according to claim 1, wherein the locking member comprises a support block, the support block having a groove formed therein configured to releasably receive the grid element.

12. The bed rail according to claim 11, wherein the groove extends over an entire length of the support block.

13. The bed rail according to claim 1, wherein the grid element comprises:

said grid rod movably supported by the locking member;

an upper horizontal cross bar;

a lower horizontal cross bar; and a plurality of fixed vertical grid rods extending between the upper horizontal cross bar and the lower horizontal cross bar.

14. The bed rail according to claim 13, wherein the plurality of fixed grid rods are fixedly attached to the upper horizontal cross bar and the lower horizontal cross bar, and wherein said grid rod movably supported by the locking member is free from the lower horizontal cross bar.

15. The bed rail according to claim 13, further comprising a plurality of positioning indentions provided on the lower cross bar.

16. The bed rail according to claim 15, wherein the locking member comprises a groove and a plurality of tenons formed within the groove, the plurality of tenons configured to engage the plurality of positioning indentions.

17. The bed rail according to claim 1, wherein the grid element engages the locking member at a central position of the grid element.

18. A bed rail for children, the bed rail comprising:

a locking member;

a mounting base; and a grid element being releasably attachable to the mounting base, wherein the grid element, in an attached state, extends along an edge of a bed above a resting area, wherein the grid element is releasably connectable with the mounting base via the locking member, the mounting base being positionable under the resting area, wherein a grid rod of the grid element is movably supported by the locking member in a moveable manner for actuation of the locking member, wherein the locking member comprises a groove extending along the grid element at least in an attached state, the groove being arranged at the grid element or the mounting base, and wherein the groove extends over just a part of a length of the grid element.

19. A bed rail assembly, comprising:

a mounting base comprising a support member; and a grid element releasably connected to the support member at a central position of the grid element, the grid element comprising:

an upper horizontal cross bar;

a lower horizontal cross bar; and a plurality of vertical grid rods extending between the upper horizontal cross bar and the lower horizontal cross bar, wherein the plurality of vertical grid rods comprises a plurality of fixed grid rods and at least one moveable grid rod.

* * * * *